US006729915B2

(12) United States Patent
Ogawa

(10) Patent No.: US 6,729,915 B2
(45) Date of Patent: May 4, 2004

(54) CONNECTOR FOR CIRCUIT BOARD AND METHOD OF ASSEMBLING IT

(75) Inventor: Shinji Ogawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 4 days.

(21) Appl. No.: 10/389,557

(22) Filed: Mar. 13, 2003

(65) Prior Publication Data

US 2003/0176086 A1 Sep. 18, 2003

(30) Foreign Application Priority Data

Mar. 15, 2002 (JP) ..... 2002-071465

(51) Int. Cl.[7] ..... H01R 13/40
(52) U.S. Cl. ..... 439/733.1; 439/382
(58) Field of Search ..... 439/733.1, 752, 439/752.5, 79, 382

(56) References Cited

U.S. PATENT DOCUMENTS 4,317,609 A * 3/1982 Lapraik ..... 439/733.1
5,645,453 A * 7/1997 Yamaguchi ..... 439/595
5,980,328 A 11/1999 Takanashi et al.

* cited by examiner

*Primary Examiner*—Tho D. Ta
(74) *Attorney, Agent, or Firm*—Gerald E. Hespos; Anthony J. Cassella

(57) ABSTRACT

Terminal fittings (10A, 10B) are inserted into cavities (21) through terminal insertion holes (22) formed at the front sides of the cavities (21) and a front holder (40) is mounted onto the front surface of a housing (20) to prevent the terminal fittings (10A, 10B) from coming out. Coupling portions (13) of the terminal fittings (10A, 10B) are positioned by shake preventing holes (23) at the rear sides of the cavities (21). Thus, the terminal fittings (10A, 10B) are prevented from shaking. Accordingly, board connecting portions (12) of the terminal fittings (10A, 10B) are aligned with precision and the connector is assembled smoothly.

18 Claims, 6 Drawing Sheets

CONNECTOR FOR CIRCUIT BOARD AND METHOD OF ASSEMBLING IT

BACKGROUND OF THE INVENTION

1. Field of the Invention

The invention relates to a connector for circuit board and to a method of assembling it.

2. Description of the Related Art

U.S. Pat. No. 5,980,328 and FIG. 6 show two different connectors for circuit boards. The connector of FIG. 6 is identified by the numeral 1, and has terminal fittings 2 disposed in cavities 3 of a housing 4. The connector 1 also includes an alignment plate 5 for aligning the terminal fittings 2. Each terminal fitting 2 has a box 2A to be connected with a mating terminal fitting and a board connecting portion 2B to be connected with a circuit board P. A coupling portion 2C couples the box 2A and the board connecting portion 2B. Each cavity 3 has an open forward end and a terminal insertion hole 3A that opens widely at the rear side of the cavity 3. The box 2A of each terminal fitting 2 is inserted into the cavity 3 through the terminal insertion hole 3A and a lock 6 formed in the cavity 3 locks the box 2A. A similar arrangement is shown in U.S. Pat. No. 5,980,328. The coupling portion 2C of each terminal fitting 2 in FIG. 6 is bent down at right angles behind the cavity 3. The board connecting portions 2B of the terminal fittings 2 are introduced through positioning holes 5A in the alignment plate 5 and the alignment plate 5 is mounted at a rear bottom portion of the housing 4. The board connecting portions 2B of the terminal fittings 2 are introduced through holes in the circuit board P and are connected with circuits on the circuit board P by soldering to fix the housing 4 on the circuit board P. A similar board mounting is achieved for the connector shown in U.S. Pat. No. 5,980,328.

The terminal fittings 2 are likely to shake because the rear sides of the cavities 3 are large. Thus, it is difficult to align the board connecting portions 2B precisely, and assembling time may be longer. Similar problems occur with the connector shown in U.S. Pat. No. 5,980,328.

The invention was developed in view of the above problem and an object is to improve the operability of mounting a connector for circuit board.

SUMMARY OF THE INVENTION

The invention relates to a connector with a housing that can be fixed to the circuit board. The housing has opposite front and rear ends and cavities that extend between the ends. Each cavity has a terminal insertion hole at the front end of the housing for receiving a terminal fitting. Each terminal fitting has a box at one end configured for connection with a mating terminal fitting. A board connecting portion is at the opposite end of the terminal fitting and is configured for connection with the circuit board. A coupling portion couples the box and the board connecting portion. The box of each terminal fitting is accommodated in the corresponding cavity and the board connecting portion extends back from the cavity. A front holder is mounted onto the front end of the housing for holding the box of the terminal fitting in the cavity. Shake preventing holes are formed at the rear ends of the cavities and hold the coupling portions without shaking.

Accordingly, terminal fittings can be inserted into the cavities through the terminal insertion holes at the front ends of the cavities by holding the box and inserting the board connecting portion first. The front holder then is mounted onto the front end of the housing to prevent the terminal fittings from coming out. The coupling portions of the terminal fittings are positioned by the shake preventing holes at the rear ends of the cavities to prevent the terminal fittings from shaking. Thus, the board connecting portions of the terminal fittings can be aligned with improved precision and the connector can be assembled more smoothly.

The shake preventing holes preferably have a smaller vertical dimension than the terminal insertion holes.

The terminal fittings preferably are constructed such that the coupling portions are bendable in or behind the cavities. Additionally, positioning walls may be formed in the cavities for contacting the rear ends of the boxes and positioning the terminal fittings longitudinally. In contrast, it had been difficult to position terminal fittings accurately in prior art terminal fittings due to a dimensional difference between the terminal fittings and the locks. Thus, there had been a variation in positions where the terminal fittings were bent and precise alignment was difficult. However, the terminal fittings of the subject invention can be bent at precise positions by bending while the box is pressed against the positioning walls. As a result, alignment precision is improved.

The boxes of the terminal fittings preferably are held between the front holder and the positioning walls.

The housing is made of a hard synthetic resin and may contain glass. Resilient members, such as locks, are difficult to form using the hard synthetic resin containing glass. Therefore, it has been difficult to make the prior art housing of a hard synthetic resin. However, it is not necessary to provide locks in the housing of the subject connector. Accordingly the housing can be made of a hard synthetic resin containing glass and has a higher strength.

The invention also relates to a method of assembling a connector for circuit board. The connector includes terminal fittings, each of which has a box to be connected with a mating terminal fitting, a board connecting portion to be connected with a circuit board and a coupling portion coupling the box portion and the board connecting portion. The method comprises providing a housing formed with cavities which are open forward and backward. The method then includes inserting the terminal fittings, board connecting portion first, into the front ends of the cavities, and accommodating the boxes of the terminal fittings in the cavities. Thus, the board connecting portions extend back from the cavities. The method then includes mounting a front holder onto the front of the housing to prevent the terminal fittings from coming out.

The terminal fitting can be inserted into the cavity from the front through terminal insertion holes. Thus, it is possible to manipulate the terminal fittings by the box, which is larger and stronger than the board connecting portion.

The step of inserting the terminal fitting preferably comprises inserting the coupling portions through shake preventing holes at the rear of the housing.

The method may further comprise fixing the housing to the circuit board.

The method may also comprise bending the coupling portions in or behind the cavities.

The step of inserting the terminal fittings may comprise urging the boxes into contact with positioning walls for positioning the terminal fittings with respect to forward and backward directions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
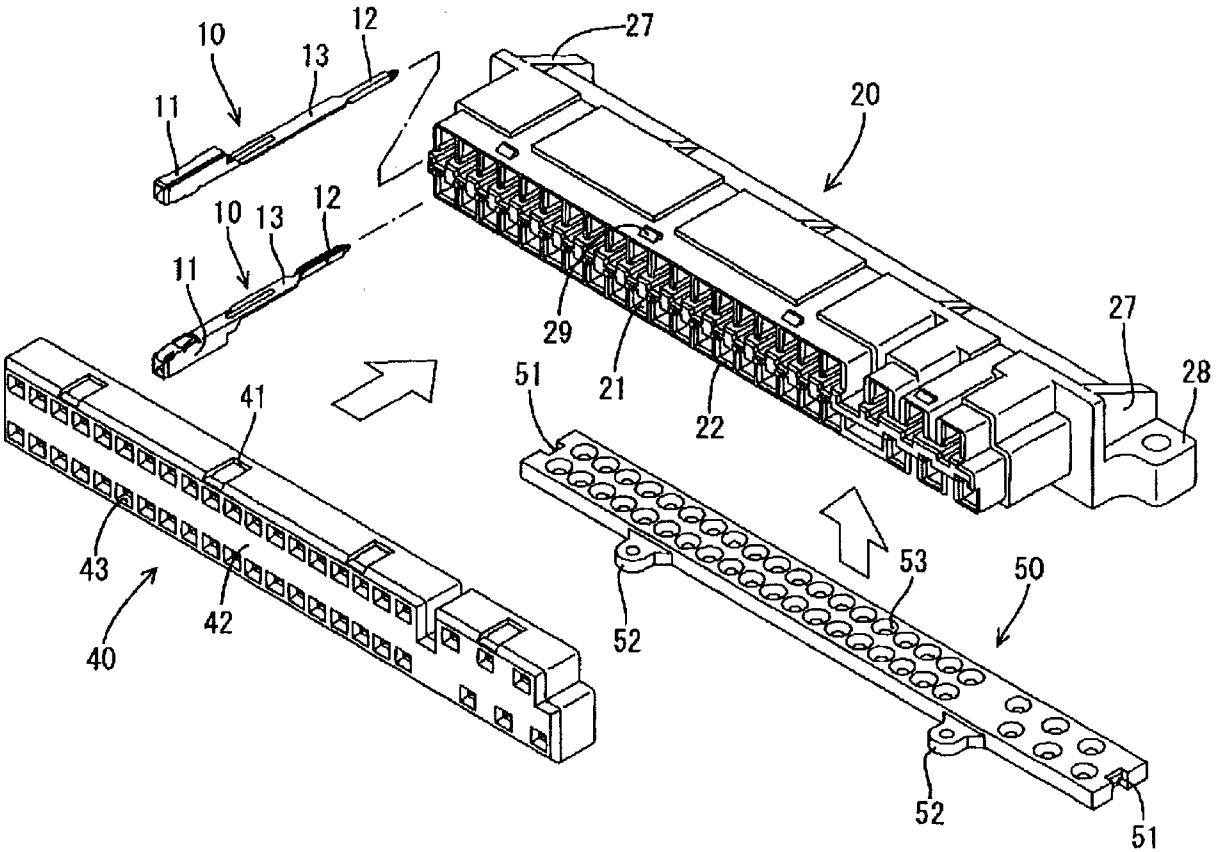
FIG. 1 is an exploded perspective view of a connector for circuit board according to one embodiment of the invention.
Figure 2:
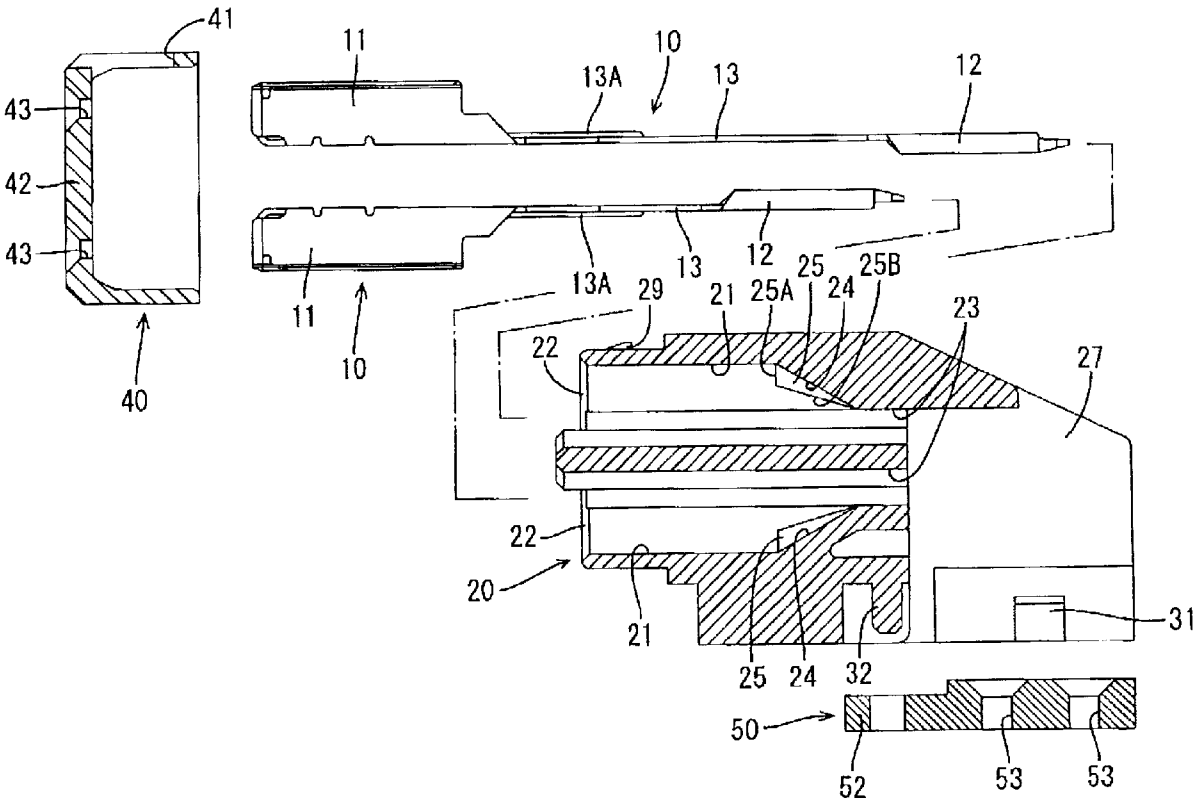
FIG. 2 is an exploded section of the connector for circuit board.
Figure 5:
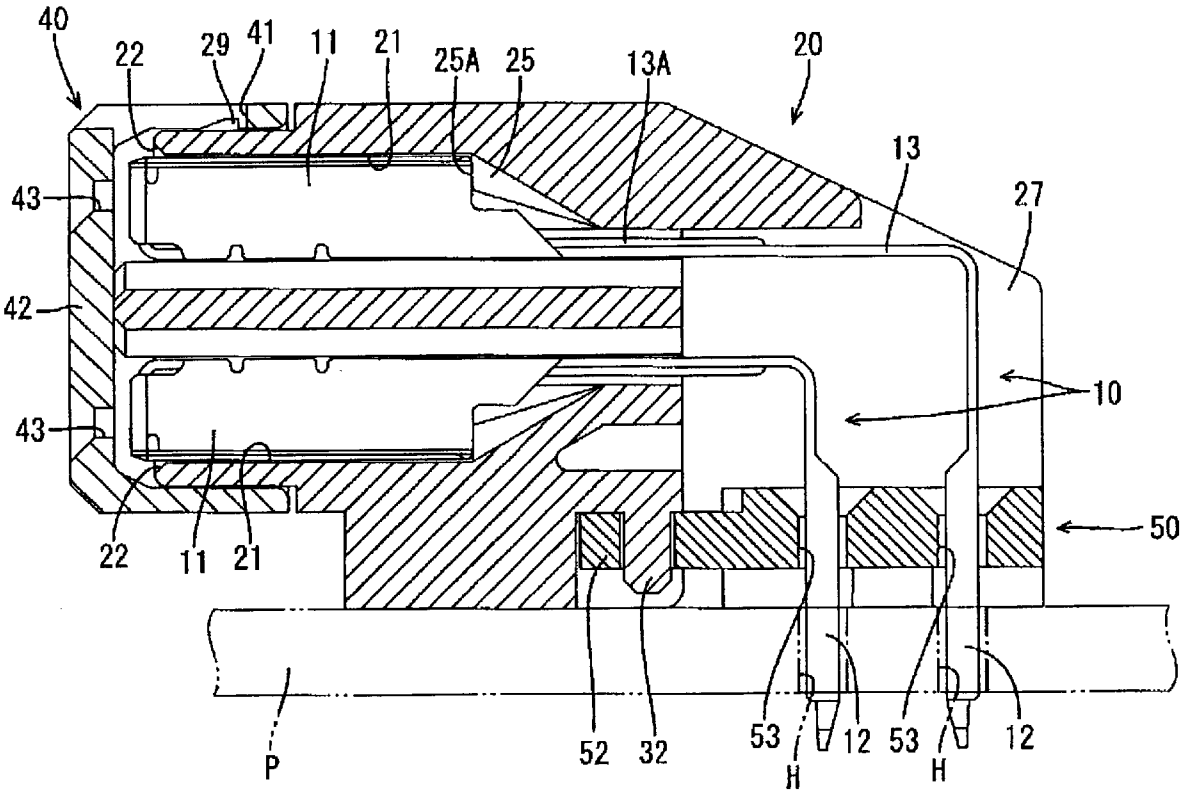
FIG. 5 is a section showing a state where the assembling of the connector for circuit board is completed.
Figure 6:
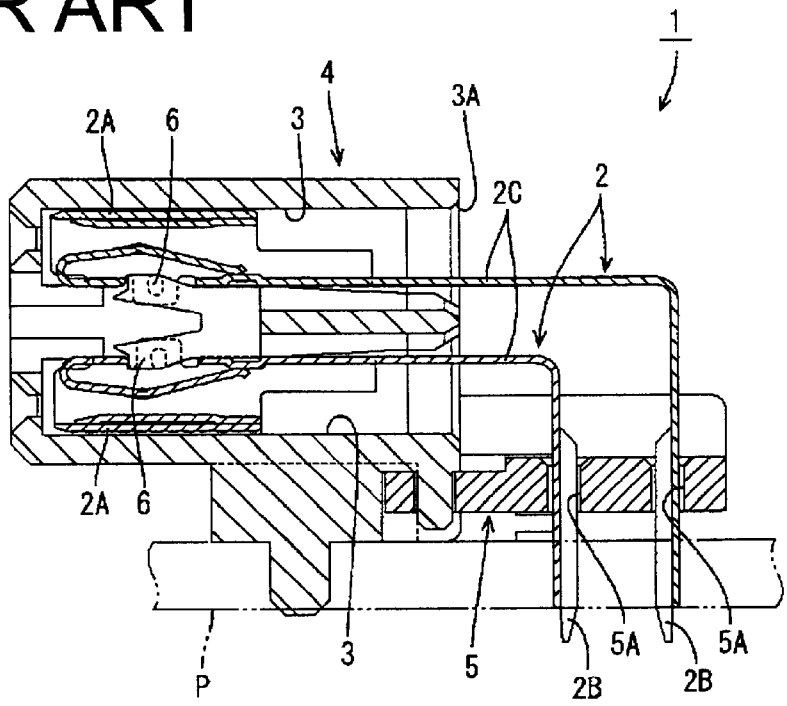
FIG. 6 PRIOR ART
FIG. 6 is a section showing a prior art connector for circuit board.

A connector for a circuit board according to the invention is shown in FIGS. 1 and 2, and has a plurality of terminal fittings 10A, 10B. Each terminal fitting 10A, 10B is made of an electrically conductive metallic plate and has opposite first and second ends. A rectangular tubular box 11 is formed at the first end and has a resilient contact (not shown) therein. A tab of a mating terminal fitting (not shown) can be inserted into the box 11 through an opening in the front surface of the box 11 to establish electrical connection with the resilient contact. A board connecting portion 12 is formed at the second end of each terminal fitting 10A, 10B. The board connecting portion 12 is formed by bending the opposite sides toward one another to increase the thickness and is configured for connection with a circuit board P (see FIG. 5). A coupling portion 13 extends between the box 11 and the board connecting portion 12. Two kinds of coupling portions 13 having different lengths are used for the terminal fittings 10A, 10B. Each coupling portion 13 is substantially in the form of a plate with a width substantially equal to the width of the box 11, but wider than the board connecting portion 12. A reinforcing rib 13A is embossed at a widthwise middle portion of the coupling portion 13 over a specified area near the box 11.

Figure 3:
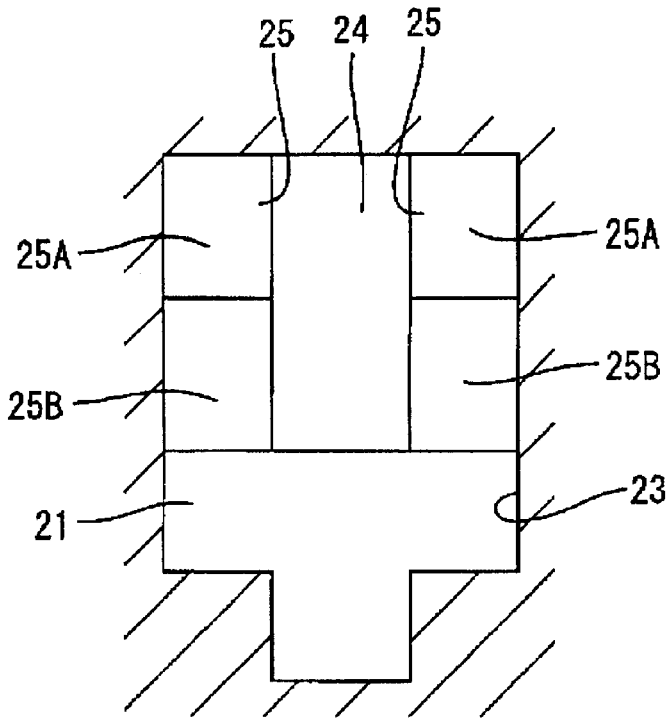
FIG. 3 is a partial enlarged section of a cavity.

The connector also has a housing 20 formed e.g. of a hard synthetic resin (e.g. PBT resin containing glass). Cavities 21 are arranged at two stages in the housing 20 and are configured to accommodate the terminal fittings 10A, 10B. The longer terminal fittings 10A are accommodated in the upper cavities 21 while the shorter terminal fittings 10B are accommodated in the lower cavities. Some embodiments may have three or more stages of cavities 21. In those embodiments, the shorter terminal fittings 10 are arranged progressively in cavities closer to the circuit board P. The open front ends of the cavities 21 define terminal insertion holes 22 that are dimensioned cross sectionally to receive the boxes 11. The open rear ends of the cavities 21 define shake preventing holes 23 and have a smaller vertical dimension than the terminal insertion holes 22. Sections of the coupling portions 13 that have the reinforcing ribs 13A can be inserted through the shake preventing holes 23 and held with a small clearance between the reinforcing ribs 13A and the opening edge of the shake preventing holes 23 along a thickness direction of the terminal fitting 10. A guide surface 24 is formed in each cavity 21 and slants to reduce the vertical dimension of the cavity 21 gradually toward the back, as shown in FIG. 3. Thus, the leading ends of the board connecting portions 12 are guided toward the shake preventing holes 23 during the insertion of the terminal fittings 10A, 10B. Two positioning walls 25 project at the left and right sides of each guide surface 24, and the terminal fitting 10A, 10B can be positioned with respect to forward and backward directions by urging the rear end of the box 11 of the terminal fitting 10A, 10B against the vertical front surfaces of the positioning walls 25. Guide surfaces 25B are formed on the bottom surfaces of the positioning walls 25 for guiding the leading end of the board connecting portion 12 toward the shake preventing hole 23.

Side walls 27 extend from the opposite left and right ends of the rear side of the housing 20, and a screw fastening portion 28 is formed at the widthwise outer side of each side wall 27 for fastening the housing 20 to the circuit board P by means of a screw.

The connector further includes a front holder 40 made e.g. of a synthetic resin. The front holder 40 is formed substantially into a box shape that opens backward and fits to the front end of the housing 20. Locking holes 41 are formed in the upper and bottom surfaces of the front holder 40. The front holder 40 is mounted to the housing 20 by engaging the locking holes 41 with corresponding locking projections 29 on the upper and lower surfaces of the housing 20. The front holder 40 is assembled such that a front wall 42 thereof substantially covers the terminal insertion holes 22 of the respective cavities 21 to prevent the terminal fittings 10A, 10B from coming out forward. The front holder 40 also positions the terminal fittings 10A, 10B with respect to forward and backward directions by holding the boxes 11 in cooperation with the positioning walls 25 while leaving small clearances. The front wall 42 is formed with tab insertion holes 43 at positions corresponding to the cavities 21. Thus, tabs of the mating terminal fittings can be inserted through the front wall 42.

The connector also is used with a wide alignment plate 50 made e.g. of a synthetic resin, and mounted at the rear bottom of the housing 20. Locking recesses 51 are formed at the left and right ends of the alignment plate 50, and engage locking projections 31 at the bottoms of the inner surfaces of the opposite side wall portions 27 of the housing 20. Two fittable portions 52 project at the front end of the alignment plate 50 and engage fitting projections 32 that project from the bottom surface of the housing 20. The alignment plate 50 also has positioning holes 53 that vertically penetrate the alignment plate 50 at positions substantially conforming to the through holes H of the circuit board P. The board connecting portions 12 of the terminal fittings 10A, 10B are inserted through the respective positioning holes 53 with a specified clearance.

The connector is assembled by inserting the board connecting portions 12 of the terminal fittings 10A, 10B through the corresponding terminal insertion holes 22 at the front of the connector and into the corresponding cavities 21. This inserting operation can be done by holding the relatively large strong box 11 instead of the relatively thin and small board connecting portion 12. Thus, the terminal fitting 10A, 10B is easy to hold despite its small size and can be prevented from inadvertent deformation. The leading end of the board connecting portion 12 contacts the guide surfaces 24, 25B during the insertion of the terminal fitting 10A, 10B, and is guided toward the shake preventing hole 23.

Figure 4:
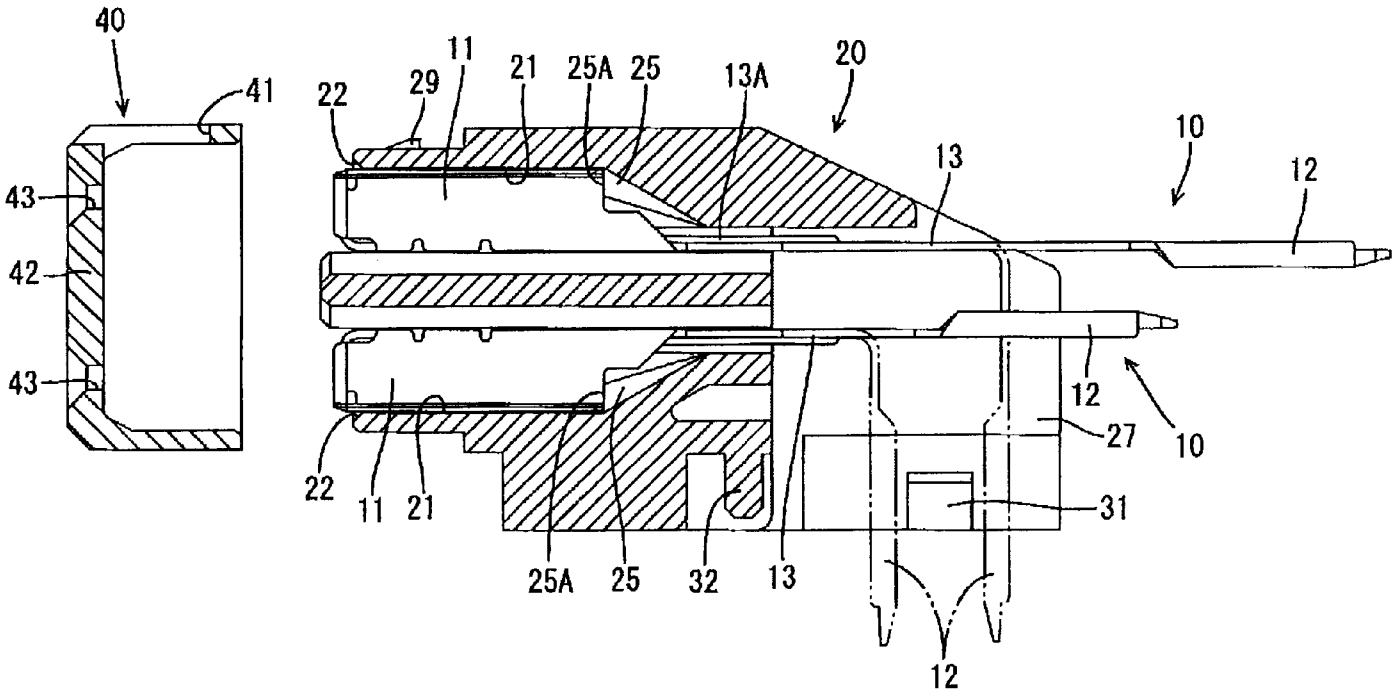
FIG. 4 is a section showing a process of mounting terminal fittings into a housing.

The rear ends of the boxes 11 contact the positioning walls 25 when the terminal fittings 10A, 10B have been inserted to proper positions, as shown in FIG. 4. Thus, the terminal fittings 10A, 10B are positioned precisely with respect to forward and backward directions. The coupling portions 13 then are bent down substantially at right angles using a jig or the like (see phantom line in FIG. 4). As a result, the terminal fittings 10A, 10B are bent at precise positions and the board connecting portions 12 are aligned with satisfactory precision.

The front holder 40 then is fit onto the front surface of the housing 20 to prevent the terminal fittings 10A, 10B. Thus, the terminal fittings 10A, 10B are positioned with respect to forward and backward directions by holding the boxes 11 between the front wall 42 and the positioning walls 25. The front wall 42 also pushes any insufficiently inserted terminal fitting 10A, 10B into a proper position in the cavity 21.

The alignment plate 50 then is mounted on the housing 20 from below by inserting the board connecting portions 12 of the respective terminal fittings 10A, 10B through the corresponding positioning holes 53. Thus, the alignment of any misaligned board connecting portions 12 is corrected. In this way, the assembling of the connector for circuit board is completed.

The connector is mounted on the circuit board P by introducing the leading ends of the respective board connecting portions 12 through the through holes H of the circuit board P. Screws (not shown) then are inserted into the screw fastening portions 28 to fasten the housing 20 in close contact with the circuit board P. Thereafter, the respective board connecting portions 12 are connected with circuits on the circuit board P e.g. by soldering, ultrasonic welding, crimping or the like.

As described above, the terminal fittings 10A, 10B are inserted into the cavities 21 through the terminal insertion holes 22 at the front sides of the cavities 21 and the front holder 40 is mounted onto the front surface of the housing 20 to prevent the terminal fittings 10A, 10B from coming out. The coupling portions 13 of the terminal fittings 10A, 10B are positioned by the shake preventing holes 23 at the rear sides of the cavities 21. Thus, the terminal fittings 10A, 10B are prevented from shaking. Additionally, the board connecting portions 12 of the terminal fittings 10A, 10B are aligned with improved precision and the connector for circuit board P is assembled more smoothly.

The terminal fittings 10A, 10B are positioned with respect to forward and backward directions by bringing the rear ends of the boxes 11 into contact with the positioning walls 25. In contrast, it is difficult to position the terminal fittings in the prior art connector with respect to forward and backward directions due to dimensional differences between the terminal fittings and the locks. Thus, there may be a variation in positions where the prior art terminal fittings are bent, and precise alignment is difficult. However, in this embodiment, the terminal fittings 10A, 10B of this invention can be bent precisely while being pressed against the positioning walls 25. As a result, the precision of the alignment is improved.

The housing 20 is made of a hard synthetic resin preferably containing glass. Resilient members, such as locks, are difficult to form using a hard synthetic resin containing glass. Accordingly, it has been difficult to make the housing of the prior art connector of a hard synthetic resin. However, the subject connector does not have resilient locks in the housing 20. As a result, the housing 20 can be made of the hard synthetic resin containing glass and is stronger.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The terminal fittings are bent at right angles at the rear side of the housing in the foregoing embodiment. However, the invention is also applicable to connectors in which terminal fittings are not bent.

The board connecting portions of the terminal fittings are aligned by the alignment plate in the foregoing embodiment. However, the invention is also applicable to connectors having no alignment plate.

What is claimed is:

1. A connector for circuit board (P), comprising:

at least one terminal fitting (10) having a box (11) for connection with a mating terminal fitting, a board connecting portion (12) for connection with a circuit board (P) and a coupling portion (13) coupling the box (11) and the board connecting portion (12); and a housing (20) having opposite front and rear ends and formed with at least one cavity (21) open at the front and rear ends, wherein:

the box (11) of the terminal fitting (10) is accommodated in the cavity (21) and the board connecting portion (12) extends back from the cavities (21);

at least one opening (22) formed at the front of the cavity (21) to define a terminal insertion hole (22) through which the terminal fitting (10) is insertable;

a front holder (40) mountable onto the front end of the housing (20) for preventing the terminal fitting (10) from coming out of the opening (22) of the cavity (21) at the front of the housing (20).

2. The connector for circuit board (P) of claim 1, wherein the housing (20) has fixing means (28) for fixing the housing (20) to the circuit board (P).

3. The connector for circuit board (P) of claim 1, wherein the coupling portions (13) are configured for bending rearward of the cavities (21).

4. The connector for circuit board (P) of claim 1, wherein the housing (20) is made of a hard synthetic resin containing glass.

5. The connector for circuit board (P) of claim 1, the cavity (21) has a shake preventing hole (23) at the rear end of the housing (20), the coupling portions (13) being positioned and held in the shake preventing hole (23).

6. The connector for circuit board (P) of claim 5, wherein the shake preventing hole (23) have at least one cross sectional dimension smaller than the terminal insertion hole (22).

7. The connector for circuit board (P) of claim 1, wherein a positioning wall (25) is formed in the cavity (21) for contacting the box (11) and positioning the terminal fitting (10) between the front and rear ends of the housing (20).

8. The connector for circuit board (P) of claim 7, wherein the box (11) is held between the front holder (40) and the positioning walls (25).

9. A connector for circuit board (P), comprising:

terminal fittings (10), each of said terminal fittings (10) having a tubular box (11) at one end, a board connecting portion (12) at an opposite end and a coupling portion (13) extending between the box (11) and the board connecting portion (12), the box (11) being cross sectionally larger than the board connecting portion (12) and the coupling portion (13);

a housing (20) having opposite front and rear ends and cavities (21) extending between the ends, a portion of each said cavity (21) adjacent the front end of the housing (20) defining a terminal insertion hole (22) and accommodating the box (11) of one of said terminal fittings (10), a portion of each said cavity (21) adjacent the rear end of the housing (20) defining a shake preventing hole (23) and accommodating the coupling portion (13) of one of the terminal fittings (10); and a front holder (40) mounted on the front end of the housing (20) for preventing the terminal fitting (10) from coming out of the terminal insertion holes (22) of the cavities (21).

10. The connector for circuit board (P) of claim 9, wherein the shake preventing holes (23) are cross sectionally smaller than the terminal insertion holes (22).

11. The connector for circuit board (P) of claim 10, wherein a positioning wall (25) is formed in each of said cavities (21), a portion of the box (11) of each of the terminal fittings (10) adjacent the coupling portion (13) engaging the positioning wall (25) of the respective cavity (21), such that each said terminal fitting is held between the respective positioning wall (25) and the front holder (40).

12. The connector for circuit board (P) of claim 11, wherein the coupling portion (13) of each said terminal fittings (10) is bent, such that the board connecting portion (12) is aligned at an angle to the box (11).

13. The connector for circuit board (P) of claim 12, further comprising an alignment plate (50) mounted to the housing (20) and holding the board connecting portions (12) in specified positions for mounting on the circuit board (P).

14. A method of assembling a connector for circuit board (P) having terminal fittings (10) each including a box (11) to be connected with a mating terminal fitting, a board connecting portion (12) to be connected with a circuit board (P) and a coupling portion (13) coupling the box (11) and the board connecting portion (12), comprising the following steps:

providing a housing (20) with opposite front and rear ends and a cavity (21) extending between the front and rear ends, the cavity (21) having a terminal insertion hole (22) open at the front end of the housing (20);

inserting the terminal fitting (10) into the terminal insertion hole (22) with the coupling portion (13) first;

advancing the terminal fitting (10) sufficiently for accommodating the box (11) in the cavities (21) and for the board connecting portion (12) to extend rearward from the cavity (21); and mounting a front holder (40) on the front end of the housing (20) to prevent the terminal fitting (10) from coming out through the terminal insertion holes (22).

15. The method of claim 14, wherein the step of advancing the terminal fitting (10) comprises pushing the box (11) into contact with a positioning wall (25) in the cavity (21) for positioning the terminal fittings (10) with respect to forward and backward directions.

16. The method of claim 14, wherein the terminal fitting (10) is inserted sufficiently for the coupling portion (13) to pass through a shake preventing hole (23) of the cavity (21) substantially at the rear end of the housing (20).

17. The method of claims 16, further comprising bending the coupling portions (13) behind the cavities (21).

18. The method of claim 17, further comprising fixing the housing (20) to the circuit board (P).

* * * * *